United States Patent [19]

Tollinger

[11] 4,014,247

[45] Mar. 29, 1977

[54] GAS-OPERATED SHOTGUN

[75] Inventor: James Tollinger, Ithaca, N.Y.

[73] Assignee: Ithaca Gun Company, Inc., Ithaca, N.Y.

[22] Filed: Nov. 19, 1974

[21] Appl. No.: 525,072

[52] U.S. Cl. ..... 89/191 A; 42/17; 42/25; 89/1 K; 89/144; 89/184

[51] Int. Cl.[2] ..... F41C 13/00

[58] Field of Search ..... 42/17, 21; 89/191 R, 89/191 A

[56] References Cited

UNITED STATES PATENTS

| | | | |
|---|---|---|---|
| 659,507 | 10/1900 | Browning | 42/17 |
| 689,283 | 12/1901 | Browning | 42/17 |
| 1,099,621 | 6/1914 | Schildbach | 42/17 |
| 2,278,589 | 4/1942 | Rutherford | 42/17 |
| 2,476,232 | 7/1949 | Williams | 42/17 |
| 2,592,858 | 4/1952 | Clarkson | 42/17 |
| 2,765,557 | 10/1956 | Roper | 42/17 |
| 2,791,855 | 5/1957 | Simmons | 42/17 |
| 3,125,821 | 3/1964 | Ruger et al. | 42/17 |
| 3,142,921 | 8/1964 | Ruger | 42/17 |
| 3,611,608 | 10/1971 | Seiberling | 42/17 |

*Primary Examiner*—Stephen C. Bentley
*Attorney, Agent, or Firm*—Brumbaugh, Graves, Donohue & Raymond

[57] ABSTRACT

A gas-operated, magazine fed firearm includes a shell carrier for receiving shells from the magazine and lifting them into chambering position. An integral shell stop and carrier latch lever pivotally mounted in the receiver latches the shell carrier in its lowered, shell-receiving position and releases a single shell from the magazine to be moved onto the shell carrier by the magazine spring. The shell stop lever blocks the following shell from moving onto the shell carrier and releases the shell carrier for transferring the shell to chambering position. The shell stop lever shifts laterally to permit shells to be loaded past the carrier into the magazine from the feeding end.

11 Claims, 14 Drawing Figures

22
84
112
114
104
169
170
4
168
33
96
20
3
2
24
116
134
32
218
174
28
216
92
88
124
162
164
90
166
86
94
126
98
190
158
188
70
68
72
74
26
76
78
80
192
37
160
214
66
54
51
186
195
50
34
62
56
60
64
58
36
120
47
48
38
46
44
122
82
37
35
84
42
43
40

222
140
150
142
146
138
148
144
152
154
30
156
4
134
3
2
22

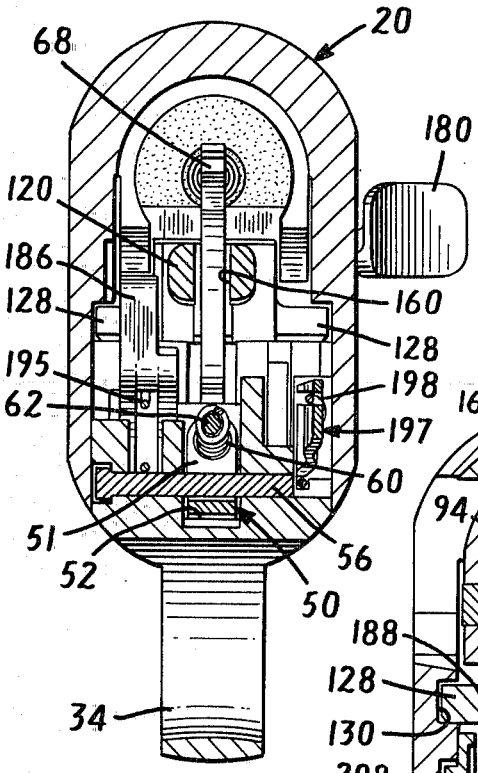
FIG. 2
FIG. 3
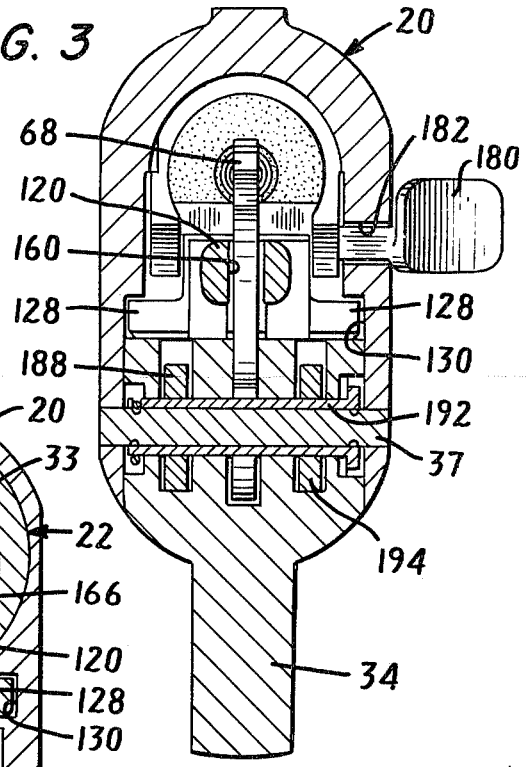
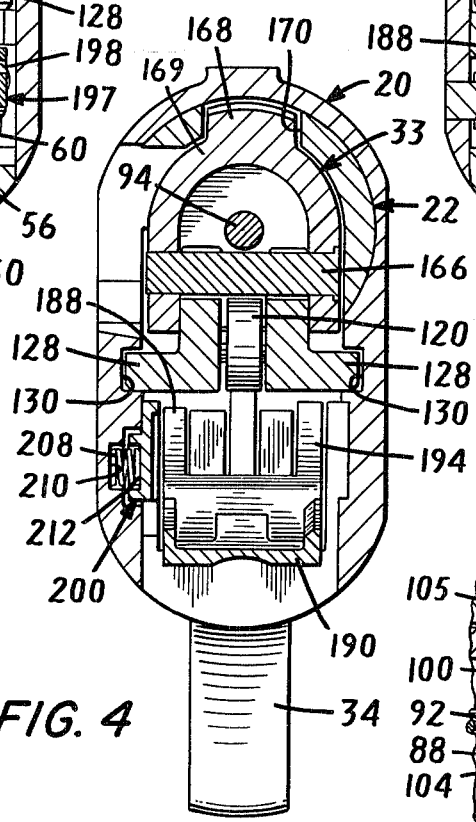
FIG. 4
FIG. 8A
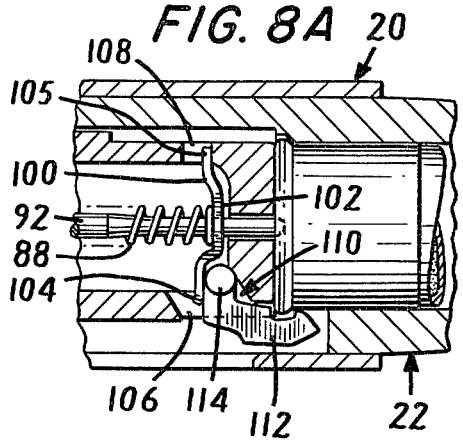
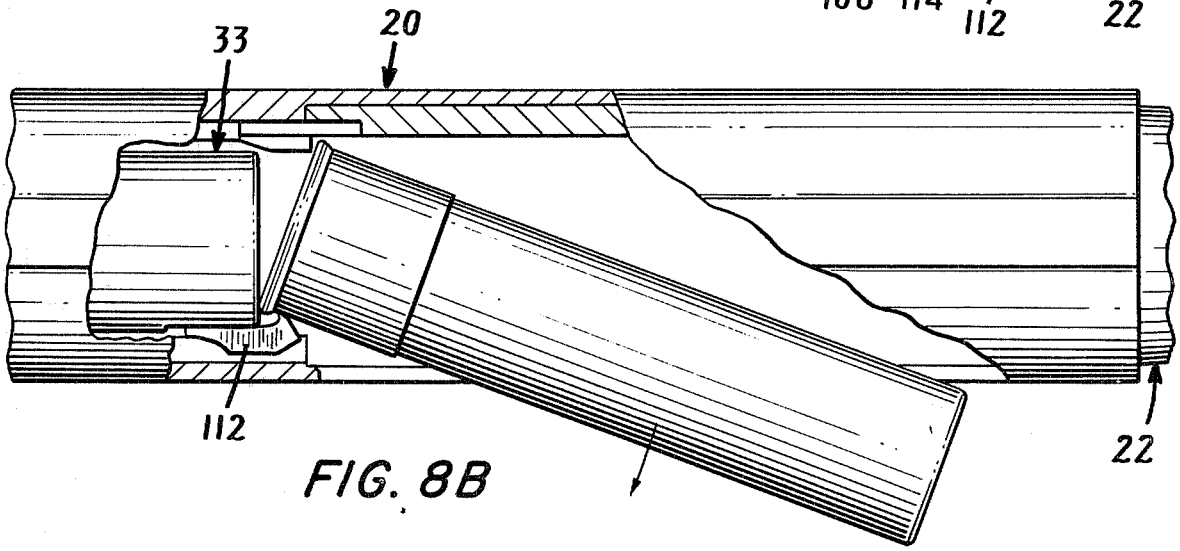
FIG. 8B

GAS-OPERATED SHOTGUN

BACKGROUND OF THE INVENTION

This invention relates to semi-automatic firearms and especially to a semi-automatic gas-operated shotgun.

The embodiment of the invention which is specifically disclosed herein is a 10-gauge shotgun. However, it must be understood that the invention as defined in the appended claims is also usable in other forms of firearms such as rifles and, naturally, shotguns of other gauges. Therefore, when terminology specific to shotguns is used, the equivalent terminology appropriate for the firearm of interest may be substituted in the disclosure and the claims. For example, the term "shells" as used herein may be replaced with "cartridge" when the invention is to be employed in a rifle.

A shell-feed system in a shotgun or a rifle, in which shells are fed from a magazine onto a shell carrier which then lifts them into position to be chambered by a bolt, should provide a shell feed control mechanism which permits the shells to be fed only one at a time from the magazine to the shell carrier so that the following shell does not jam the shell carrier. This can be done by providing a shell stop which is operated by the shell being fed from the magazine to stop the following shell in the magazine from protruding over, and jamming, the shell carrier.

The shell stop should also permit loading of the magazine from the feeding end by shifting out of its position in order to leave an unimpeded path for the passage of the shells forwardly into the magazine.

In the prior art, this function is accomplished by use of primary and secondary shell stops, or by an intricate assemblage of levers and spring which complicate the mechanism, increasing its costs and decreasing its reliability.

Another problem encountered in firearms of this nature is the problem of latching the shell carrier during the cycle of operation of the firearm in which the shell is to be advanced onto the shell carrier, and to unlatch the shell carrier when the shell is to be lifted to chambering position and also when the firearm is in breech position so that the shells may be loaded into the magazine. In the prior art, a latch is provided which holds the shell carrier in its lowered, shell-receiving position. The latch is necessary to prevent the rearward travel of the slide from causing the shell carrier prematurely to begin rising toward its shell chambering position before the shell has fully loaded onto the carrier. The carrier must remain in its loading position until the shell is clear of the magazine and in correct position on the carrier or the shell will jam the carrier midway in its travel toward chambering position. The latch is usually tripped by the shell when it has fully loaded onto the shell carrier.

The latch also holds the carrier in its loading position when the gun is in the breech position, to prevent the carrier from kicking upward, under the influence of the recoil, into the path of the shell being fed from the magazine. Otherwise, the carrier could be jammed by the feeding shell or fail to receive and load the shell altogether. Although the latch usually performs its function well enough, it does represent an additional part which adds to the expense and reduces the reliability of the gun.

In a semi-automatic firearm, or "auto loader," in which a shell is reloaded and the action is cocked by the discharge of the firearm, it is necessary to provide a mechanism for disabling the trigger so that continued rearward pressure on the trigger does not release the hammer and permit it to ride forward with the bolt on its return stroke, thereby uncocking the gun. All semi-automatic weapons are equipped with a mechanism of this nature, usually called a "trigger disconnect."

The trigger disconnect is usually placed low in the trigger housing where it is nearly inaccessible without disassembling the trigger housing assembly. It should thus be simple and rugged to ensure that it will operate irrespective of neglect and abuse by the owner. Therefore, it should not be dependent on proper cleaning and oiling but it must operate reliably under any condition in which the gun might conceivably operate.

To maximize the reliability of the trigger disconnect structure, it must be formed of simple, rugged parts and be of a design which does not depend for its operation on small tolerances of closely fitting pieces or on fine design shapes which are subject to wear and failure in the presence of dirt or abusive treatment. Moreover, to decrease the cost, the parts should be of simple design amenable to mass production manufacture and simple, fast and trouble-free assembly.

A rifle or a shotgun is often used in the field far removed from a gunsmith or a well equipped shop, and therefore it is desirable that it be possible easily to disassemble the shotgun to its major assemblies to facilitate cleaning and oiling. Therefore, it is desirable that the shotgun be easily disassembled without the use of tools and, when assembled, it must positively be prevented from inadvertant disassembly or loss of parts.

To remove the bolt from the receiver in a shotgun, it is necessary to remove the charging handle. Prior art shotguns employ screws or spring assemblies to hold the charging handle in the receiver, and require the use of tools to remove the charging handle. Even the screws and spring arrangements, however, have not been sufficient to prevent occasional loss of the charging handle during use of the shotgun. These complicated assemblies have thus done little to decrease the chance of loss of the charging handle, but have added to the cost, assembly time and difficulty of field stripping the guns. Therefore, the art has long sought, in vain, for a simple and reliable arrangement for securely holding the charging handle in the bolt and slide.

Another persistent problem in the past has been the case and frequency with which shotgun shell extractors can become dislodged and lost. An extractor, by its very nature, must be pivotally and removably mounted within the bolt to be able properly to engage the rim of the shell, and to be replaceable when it becomes worn. In the past, the necessity for pivotally mounting the extractor removably in the bolt has also meant that the extractor can, and does, become dislodged and lost. Therefore, it has been a long and heretofore fruitless effort in the art to design an extractor to operate pivotally and yet reliably engages the shell rim and is positively held in place against inadvertently becoming dislodged and lost, while being easily replaceable in the event of breakage or wear.

SUMMARY OF THE INVENTION

A shotgun is disclosed herein having the aforementioned desirable attributes of a shotgun, namely simplicity of design, a mechanism formed of simple and rugged parts which are easily, quickly and economically manufactured and assembled, and a design configuration which is highly reliable in operation and is not critically dependent on the scrupulous cleaning and oiling of the firearm, and which will not malfunction in the event of ordinary wear caused by extended periods of use or periods of abusive treatment.

The shell feed control mechanism includes a unitary integral shell stop and carrier latch lever (hereinafter referred to for brevity as "stop lever") which latches the shell carrier in its lowered, shell-receiving position in the breech position and in the open position of the gun. The stop lever is released by a release lever operated by the rearwardly moving slide to release a shell to load onto the shell carrier. The shell feeding from the magazine onto the carrier actuates the stop lever to unlatch the carrier so it may lift the shell into chambering position. The stop lever is mounted in the receiver to shift laterally and permit the loading of shells past the forward end of the stop lever into the magazine.

The gun according to this invention also includes a trigger disconnect having a simple rocker member which carries the hammer sear. The rocker member is spring biased to disconnect from the trigger and slide into position to re-engage the hammer as soon as the hammer is released. The rocker member remains disconnected from the trigger until the trigger is released, whereupon it re-engages the trigger. In this way, the gun will fire with each pull on the trigger, and the hammer will reliably cock each time the gun is fired. "Doubles", or unintentional multiple discharges of the gun caused by vibration in the gun when the slide reaches the forward end of its travel, are prevented by biasing the rocker member toward engagement with the hammer, so that the rocker member rides with the hammer as the gun vibrates, rather than independently of the hammer.

The design of the disclosed shotgun assures that the charging handle and the extractor, pieces which in prior art guns often become inadvertently dislodged and lost, are positively locked in place until the gun is deliberately disassembled. The charging handle in the gun includes a body having a non-round cross-section which slides into a corresponding non-round transversely extending opening in the slide block. An upstanding vane fits into a recess in the slide block on the inside of the bolt to prevent the charging handle from sliding laterally out of the receiver. To remove the charging handle, it is necessary merely to remove the barrel which permits the bolt to cock upwardly at its forward end, thereby clearing the top end of the vane and permitting the charging handle to be simply slid out of the receiver.

The extractor in the inventive gun includes a vertically extending trunnion which extends above and below a slot in the bolt of the inside thereof. The extractor hook extends through the slot in the bolt to engage the shell rim. An extractor retainer lies across the bolt at its inside front end and it is urged against the extractor by the firing pin spring to rotate the extractor hook into engagement with the shell rim. The extractor retainer is held in place by the firing pin which extends through a central bore in the extractor retainer. To remove the extractor, the bolt is removed from the gun and the firing pin is withdrawn clear of the extractor retainer. The extractor and extractor retainer can then fall out of the open bottom of the bolt.

The disassembly of the disclosed shotgun is a simple and fast operation and it can be done in the field without the use of tools.

DESCRIPTION OF THE DRAWINGS

The qualities of the inventive gun will be better understood on reading the following description of the preferred embodiment in conjunction with the following drawings, wherein:

FIG. 2 is a cross-section along lines 2—2 in FIG. 1;

FIG. 3 is a cross-section along lines 3—3 in FIG. 1;

FIG. 4 is a cross-section along lines 4—4 in FIG. 1;

FIG. 8A is a plan in section along lines 8A—8A in FIG. 1;

FIG. 8B is a plan, partly in section, of the receiver showing operation of the extractor and ejector;

DESCRIPTION OF THE PREFERRED EMBODIMENT

Figure 1A:
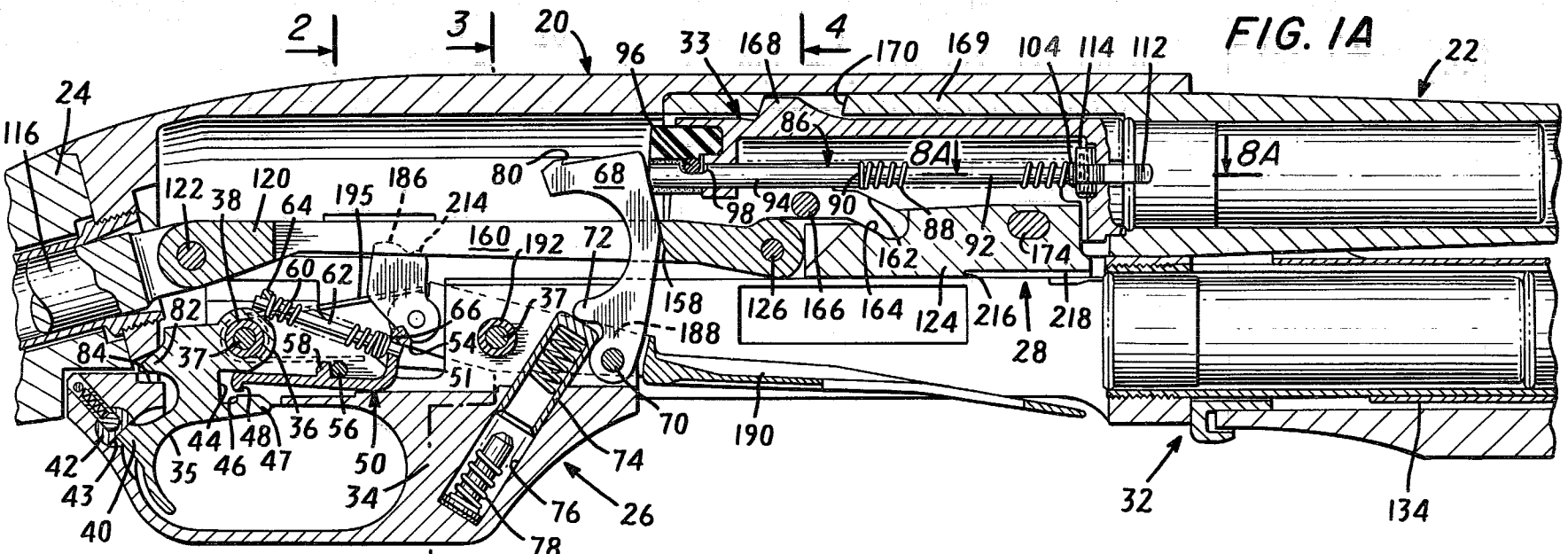
FIG. 1 is a cross-sectional elevation of a shotgun according to the invention, broken at the chamber into FIGS. 1A and 1B.
Figure 1B:
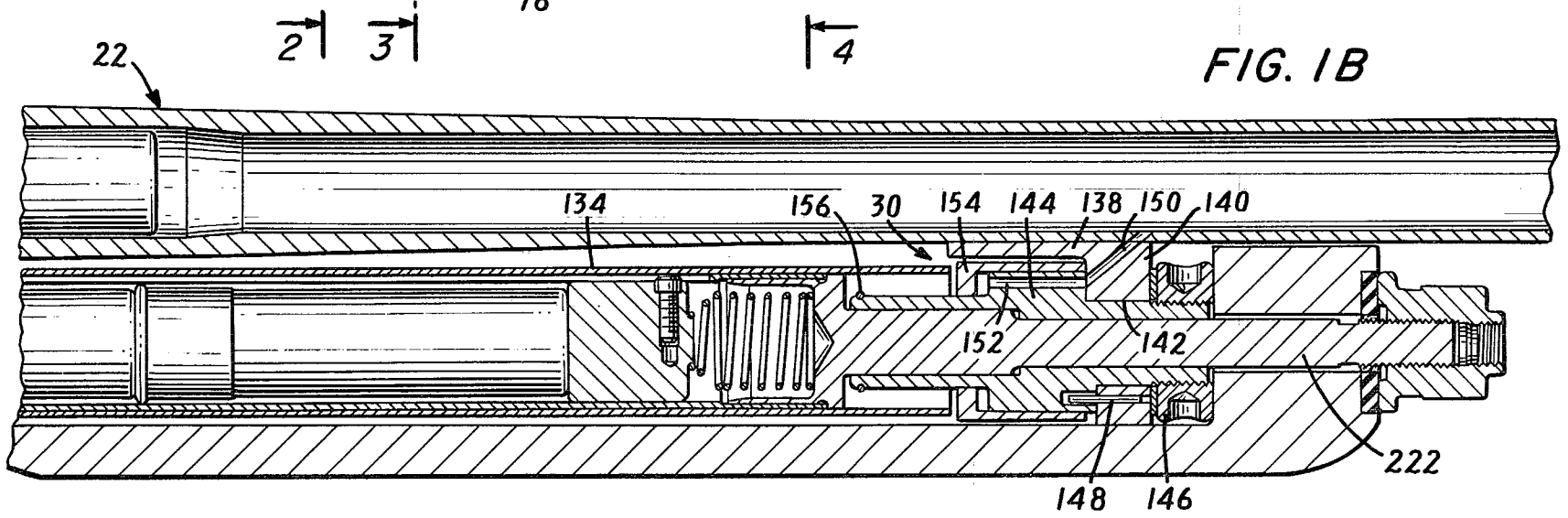

Referring now to the drawings, wherein like reference characters designate identical parts, and more particularly to FIGS. 1A and 1B, thereof, a shotgun is shown having a receiver 20 in the forward end of which is mounted a barrel 22 and on the rearward end of which is mounted a shoulder stock 24. A trigger housing assembly 26 is mounted in the rear end of the receiver 20 from beneath, and a slide assembly 28 is mounted in the receiver 20 for sliding movement and rearward in response impulses from a gas-operated action assembly 30 and forward under the urging of a return spring (not shown in the shoulder stock 24). A magazine assembly 32 is attached to the forward end of the receiver beneath the barrel in a position to feed shells into the receiver and to accept shells fed through an opening in the underside of the receiver into the magazine in a manner to be explained more fully hereinafter. A bolt assembly 33 is mounted in the receiver 20 for forward and rearward movement under control of the slide assembly 28 for chambering shells fed from the magazine, sealing the breech of the barrel while the shell is fired, and extracting and ejecting the spent shell casing.

The trigger housing assembly 26 includes a housing 34 removably mounted in the receiver 20 and locked in place by a pair of pins 37 which extent completely through the trigger housing 34 and into aligned holes in the receiver walls. A trigger 35 having a centrally bored ear 36 is pivotally mounted on a trigger pivot bushing 38 fixed in the housing 34 and through which extends the rear pin 37. The trigger 35 includes a rearwardly projecting spur 40 aligned with a detent-loaded safety slide 42. The safety slide 42 includes a full diameter portion (not shown) which, when aligned with the trigger spur 40, blocks the trigger from being pulled to the rear. The safety slide 42 also includes a cut-out portion 43 which, when aligned with the trigger spur 40, receives the spur 40 when the trigger is pulled and the shotgun is fired.

A forwardly opening recess 44 is formed in the trigger 35 just beneath the trigger mounting ear 36. The forward portion of the inside of the bottom wall 47 of the recess is stepped up to form a shoulder 46 to engage and pull on a downwardly extending hook 48 of an anti-repeat rocker member 50 when the trigger is pulled.

The anti-repeat rocker member 50 slides in a longitudinally extending channel 52 (best shown in FIG. 2) formed in the floor of the trigger housing 34. The forward end of the rocker member 50 is bent upward at approximately 90° to form an upstanding right angle portion 51 above one half as long as the horizontal portion. A forwarding facing sear 54 is formed on the upper end of the right angle portion 51.

A pin 56 is mounted in the trigger housing 34 across the channel 52 in which the rocker member 50 slides. An upright lug 58 is formed on the top surface of the rocker member 50 approximately halfway along the horizontal portion of its length, for engaging the pin 56 to limit the forward motion of the rocker member 50.

The rocker member 50 is biased by a triple-acting spring 60 toward its forward-most position, in which the upright lug 58 engages the pin 56. The spring 60 is concentrically mounted on a rod 62 which extends through an opening in the upright portion 51 of the rocker member 50, adjacent the sear 54. At the other end, the rod 62 extends through an opening in an ear 64 extending generally upwardly from the trigger mounting gear 36. The rod 62 has a fixed collar 66 near the end adjacent the sear 54 against which the spring 60 bears, and the spring bears at its other end against the ear 64. The spring 60 thus pushes the collar 66 on the rod 62 against the top end of the right angle portion 51 of the rocker member 50 to bias the rocker member 50 forward and clockwise about the pin 56.

A hammer 68 is pivotally mounted in the trigger housing 34 on a hammer pivot pin 70. A thumb 72 is formed on the hammer and engages a cup 74, slidably mounted in a recess 76, and biased upwardly against the hammer by a spring 78.

A catch 80 is formed on the hammer in a position to be engaged by the sear 54 when the hammer is cammed counterclockwise to the rear about the hammer pivot pin 70. The spring 60 biases the rocker member towards its forwardmost position, to the limit permitted by engagement of the upright lug 58 with the pin 66, so that the sear 54 on the rocker member 50 is in position to engage the catch 80 on the hammer. In its cocked position, the hammer 68 exerts an upward force on the rocker member 50 which is stronger than the downward force exerted by the spring 60 on the rocker member. The upward forces exerted by the hammer causes the rocker member 50 to rotate counterclockwise about the pin 56 so that the downwardly extending hook 48 of the rocker member 50 engages the shoulder 46 in the trigger recess 44.

A rearward pull on the trigger causs the rocker member 50 to slide to the rear and disengage the sear 54 from the catch 80 on the hammer 68 to fire the gun. When the hammer has disengaged from the sear 54, the upward force on the rocker member 50 is removed so that the spring 62 is no longer overpowered and can rotate the rocker member 50 clockwise about the pin 56. This clockwise rotation of the rocker member 50 lifts the rear end of the rocker member so that the hook 48 at the rear end of the rocker member 50 disengages from the shoulder 46 in the trigger. The rocker member 50, thus disengaged from the trigger shoulder 46 is pushed forward by the biasing spring 60 to the full extent permitted by the engagement of the lug 58 with the pin 56 so that the sear 54 is again in position to engage the catch 80 on the hammer 68 when the hammer is rotated counterclockwise again about its pivot 70 by the movement of the slide assembly 28, to be more fully described below. The hammer is thus caught by the sear and retained in its cocked position irrespective of whether the trigger is held in its rearward position or released.

When the rearward force on the trigger is not released after the gun is fired, the trigger remains in its rearward-most position but the rocker member 50 is moved to its forward-most position by the spring 60, as described. The hammer catch 80 is caught by the sear 54 and the upward force of the spring 78 overpowers the downward force of the spring 60, and rotates the rocker member 50 about the pin 56 to the extent permitted by the engagement of the end of the rocker member 50 with the forward portion of the bottom wall 47 of the trigger recess 44. When the rearward force on the trigger is relieved, the spring 60 acting against the ear 64 of the trigger rotates the trigger counterclockwise about the trigger pivot pin 38 to the extent permitted by a rearwardly extending nose 82 formed on the trigger 35 engaging the floor of a recess 84 in the trigger housing 34. When the trigger has rotated counterclockwise as far as it can, the force of the hammer spring 78 acting on the hammer 68 and thence on the rocker member 50 overcomes the clockwise force exerted by the spring 60 on the rocker member 50, and causes the rocker member 50 to rotate about the pin 56 so that the hook 48 drops behind the shoulder 46 in the bottom wall 47 of the recess 44.

Thus, the spring 60 of the trigger disconnect structure fills three functions. First, it biases the rocker member 50 forwardly into position in which the sear 54 can engage the catch 80 of the hammer 68. Secondly, the spring 60 biases the rocker member 50 for clockwise rotation about the pin 56 to lift the hook 48 out of engagement with the shoulder 46 in the trigger recess wall 47 so that, after the initial pull of the trigger, the rocker member can lift out of engagement with the trigger and slide forward under the force of the spring 60 so that the sear 54 can re-engage the catch 80 on the hammer 68 to prevent the hammer from riding forward with the bolt, thereby uncocking the gun. Third, the spring 60 acts as a trigger spring to bias the trigger for counterclockwise rotation about the trigger pivot pin 38.

When the trigger 36 is pulled, the rocker member 50 is pulled to the rear, thereby releasing the hammer 68 which is rotated forcefully about its pivot 70 in the clockwise direction toward the bolt 33 where it strikes a firing pin 86 which is slidably mounted in the bolt 33. A spring 88 bears against a shoulder 90 formed at the junction of a reduced diameter portion 92 of the firing pin with the full diameter portion 94.

The firing pin is retained in position in the bolt 33, within its forward and rearward sliding limits, by a pin 96 fixed transversely to the axis of the bolt and passing through a notch 98 cut transversely into the top of the full diameter portion 94 of the firing pin 86. In the normal position of the firing pin, which it occupies when the hammer 68 is cocked, the firing pin is pushed toward the rear by the biasing spring 88, to the limit permitted by the forward wall of the notch 98, so that the forward end of the firing pin is out of contact with the shell.

The front end of the firing pin passes through a hole in the front face of the bolt and the rear end of the firing pin passes through a hole in the rear face of the bolt. The bolt is generally hollow and is open at the bottom. To remove the firing pin, the bolt 33 is removed from the receiver 20 and the pin 96 is withdrawn laterally from the bolt which frees the firing pin to be withdrawn through the back of the bolt.

As is shown best in FIG. 8A, the front end of the firing pin passes through a central opening in an extractor retainer 100. The front end of the firing pin spring 88 bears against the extractor retainer 100 and biases it forward. The extractor retainer includes a central disc 102 and a pair of fingers 104 and 105 which extent from diametrically opposite lateral sides of the disc 102. The fingers 104 and 105 extend into diametrically opposed openings 106 and 108, respectively, in opposite sides of the bolt.

An extractor 110 is mounted in the forward end of the bolt 33 and includes a hook portion 112 which extends through the slot 106, and an integral trunnion 114 which lies in a semi-cylindrical recess within the bolt and extends vertically beyond the top and bottom edges of the slot 106 to prevent the extractor from pulling through the slot 106 and out of the bolt. The trunnion 114 permits the extractor to pivot, or swing laterally, so that the hook 112 can engage the rim of the shell. The finger 104 of the extractor retainer 100 engages the trunnion and the rear-most portion of the hook 112 to hold the extractor forward in the slot 106 and also to bias the extractor for rotation counterclockwise in the semi-cylindrical recess in the bolt so that the hook positively engages the rim of the shell when the bolt is moved forwardly into its breech position.

To remove the extractor, it is a simple matter to remove the firing pin 86 and the firing pin spring 88 which releases the forward biasing force on the extractor retainer 100 and permits the extractor to be withdrawn rearwardly into the interior of the bolt until the hook 112 has cleared the slot 106. The extractor can then drop through the open bottom of the bolt 33.

The slide assembly 28 includes a pair of plungers 116, only the forward one of which is shown. The plungers 116 fit within a bore in the shoulder stock 24 and are separated by a return spring (not shown). The front plunger 116 is pivotally connected to a link 120 by a pivot pin 122. The link 120 extends forwardly through the receiver 20 and is connected at the other end thereof to a slide block 124 by means of another pivot pin 126.

The slide block 124 has a pair of wings 128, best shown in FIGS. 3 and 4, which are received in grooves 130 in the opposite vertical walls of the receiver 20. The grooves 130 guide the movement of the slide block 124 forward under the action of the return spring, and rearward under the impulse of the gas-operated action assembly 30.

The gas-operated action assembly 30 includes a slide tube 134 mounted circumferentially around the magazine assembly 32, and a gas system at the forward end of the slide tube 134 for driving it rearwardly. The rearward end of the slide tube 134 is cut down as shown most clearly in FIG. 5, and terminates in a pair of rearwardly extending fingers 136 which project rearwardly through the receiver 20 and into the grooves 130 where they can engage the forward end of the slide block to deliver operating impulses from the gas system.

Looking again at FIG. 1B, the gas system of the gas-operated action assembly 30 includes a lug 138 rigidly affixed to the barrel 22. The lug may be integrally formed as part of the barrel or may be attached thereto by welding or the like so that it will not shift position. A tongue 140 extending downwardly from the forward end of the lug 138 has formed therethrough an opening 142 through which extends a reduced diameter portion of a stationary piston member 144. The forward end of the reduced diameter portion is threaded and receives a nut 146 to hold the piston 144 rigidly in place on the tongue 140. An alignment pin 148 extends into aligned bores in the tongue 140 and the piston member 144 to ensure correct alignment thereof. A gas port 150 extends through the barrel and through the lug 138 to the rear face of the tongue 140 and opens into an aligned gas port 152 in the stationary piston member 144.

A movable gas cylinder 154 is mounted on the stationary piston member 144 for axial movement along the piston 144. A stop ring 156 is affixed to the rear end of the stationary piston member 144 to prevent the piston member from over-travel to the rear.

When the gun is fired, the gas pressure which develops behind the shot charge pressurizes the space between the movable gas cylinder 154 and the piston 144 and forces the cylinder 154 to the rear. The rearwardly moving piston drives the slide tube 134 to the rear, which drives the fingers 136 against the slide block 124 to force it to the rear. In this way, gas pressure from the shell is used to generate a rearwardly directed force to operate the ejecting and loading mechanism of the shotgun as appears hereinafter.

As the slide commences its movement to the rear under the influence of the slide tube 134, a cam surface 158 in a slot 160 formed in the link 120, engages the front face of the hammer 68 and rotates it to the rear to be caught and held by the sear 54 as described above. Simultaneously, a cam surface 162 in a slot 164 formed in the slide block 124 engages a pin 66 extending transversely through the bolt 33 and cams the bolt downward to disengage an upwardly extending shoulder 168 from a recess 170 in an extension 169 of the barrel 22, which extends into the receiver. When the shoulder 168 has dropped clear of the recess 170, the bolt 33 is unlocked and can be slit to the rear by a charging handle 172 mounted in the slide assembly 28.

Figure 11:
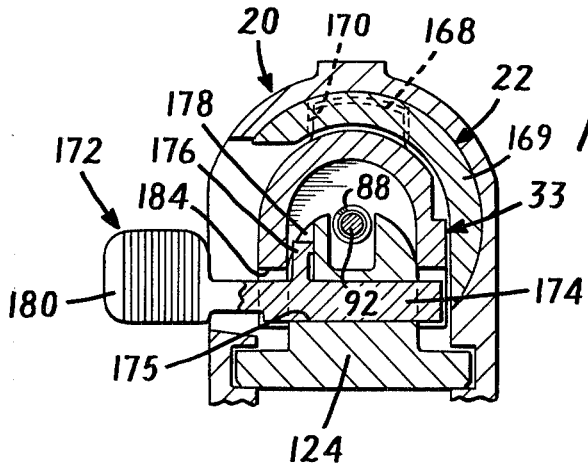
FIG. 11 is a sectional elevation along lines 11—11 in FIG. 9.

Looking now at FIG. 11, the charging handle 172 includes a body portion 174 with an elliptical cross-section. The body portion fits into a laterally extending bore 175 also having an elliptical cross-section, in the slide block 124. The elliptical cross-section prevents the charging handle 172 from turning about its longitudinal axis in use, but permits its withdrawal from the gun when desired, as will be explained in more detail hereinafter.

An upright vane 176 is formed on the elliptical body 174 of the charging handle and fits within a recess 178 formed on one side of the slide block 124. A curved gripper 180 extends through an elongated opening 182 in the receiver to provide a means by which the slide assembly 128 can be manually operated.

Figure 10:
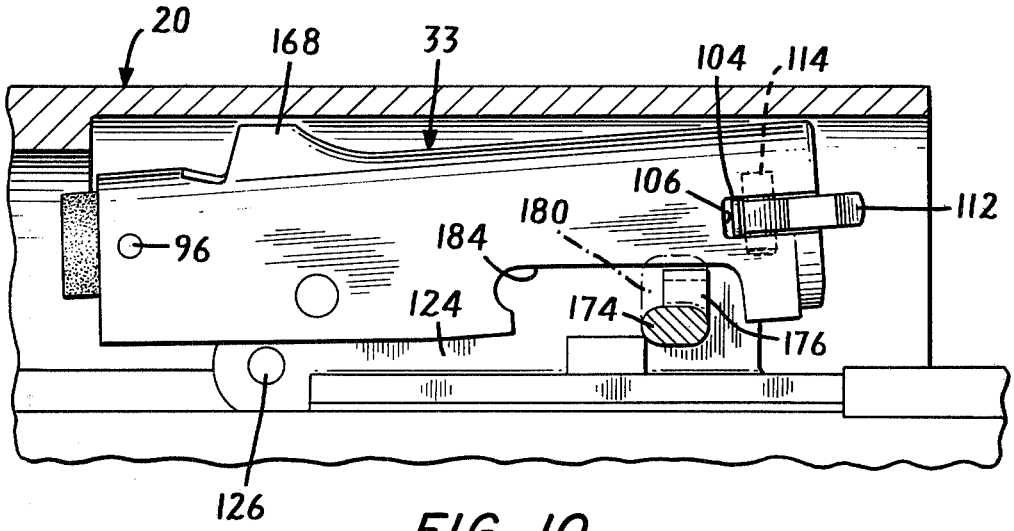
FIG. 10 is an elevation similar to FIG. 9, but showing the barrel removed and the bolt raised to permit removal of the charging handle.

An elongated downwardly opening slot is formed in the lateral side of the bolt 33 which fits over the elliptical body portion 174 of the charging handle 172. The vane 176, as shown in FIG. 11, extends vertically beyond the top edge of the recess 184 and prevents the charging handle from being withdrawn from the gun through the shell ejection portion in the receiver 20. However, when it is desired to remove the charging handle, it is a simple matter to remove the barrel 22 which then provides room for the bolt 33 to be tilted upwardly against the inside wall of the receiver as shown in FIG. 10. In this position, the top edge of the recess 184 is raised above the top edge of the vane 176 so that the charging handle 172 can be simply withdrawn from the receiver.

After the slide block 124 has cammed the bolt downwardly so that the bolt shoulder 168 has disengaged from the recess 170 in the barrel 22, the body 174 of the charging handle 172 engages the rear end of the recess 184 in the bolt and the bolt commences its movement to the rear. The spent shell is then withdrawn from the chamber by the engagement of the extractor hook 112 with the rim of the shell and the shell is withdrawn to the rear. When the front of the shell has cleared the ejection opening in the receiver, the diametrically opposite edge of the rim of the shell engages an ejector which, in connection with the continued rearward movement of the bolt, ejects the shell from the receiver in a known manner.

As the slide continues to the rear under the influence of the impulse delivered by the slide tube 134, the left-hand wing 128 of the slide block 124 engages a cam 186 which is pivotally mounted on the left mounting leg 188 of a shell carrier 190. The shell carrier is pivotally mounted in the trigger housing 34 by means of a bushing 192 fixed in the trigger housing and extending through the left mounting leg 188 and also a right mounting leg 194 of the shell carrier.

The cam 186 is spring biased to its upright position shown in FIG. 1 by a torsion spring 195 which extends around the trigger mounting bushing 38, bearing at its bottom end against the stop pin 56 and bearing at its top end against the cam 186. The cam 186 is bifurcated at one end, and the bifurcations bracket the left mounting leg 188 of the shell carrier. The end of the torsion spring extends between bifurcations of the cam and urges the cam to rotate about the pivot pin to the extent permitted by engagement of the front face of the cam with a shoulder formed near the end of the mounting leg for the purpose of limiting rotation to the position shown in FIG. 1A.

As the slide continues to the rear, after cocking the cam 186 counterclockwise about its mounting pin on the left mounting leg 188 of the shell carrier 190, the slide next engages the raised rear end 196 of the release lever 197. The release lever is mounted for rotation in a vertical plane on the same bushing 192 on which the mounting legs of the shell carrier are mounted. The release lever 197 is biased to rotate in a clockwise direction about its mounting bushing by a torsion spring 198.

Figure 7A:
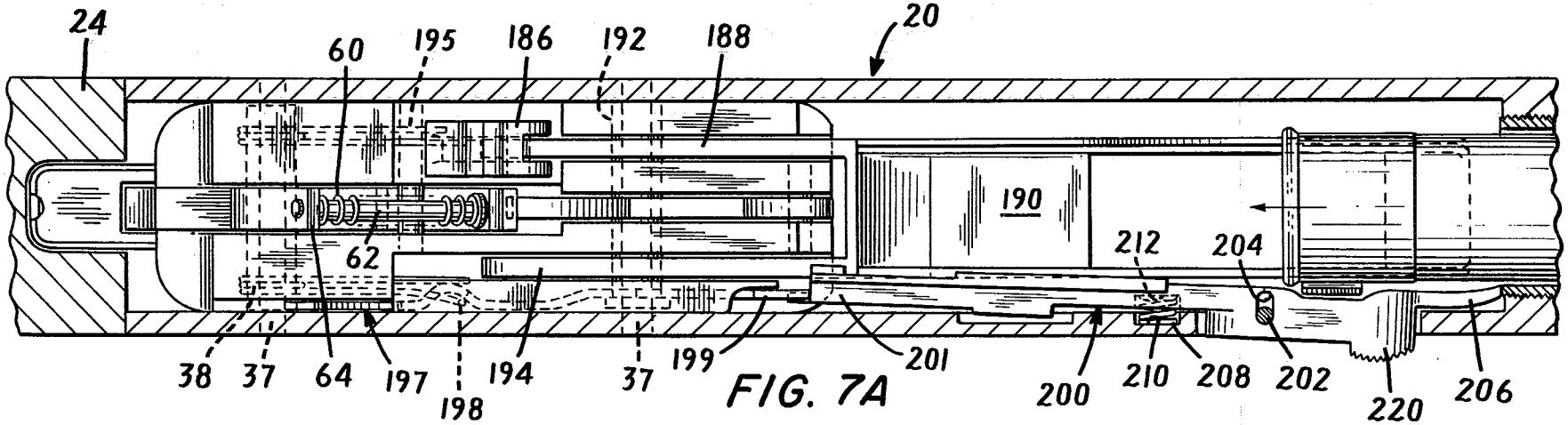
FIG. 7A is a plan, partly in section, of the receiver showing a shell in motion from the magazine onto the shell carrier.
Figure 7B:
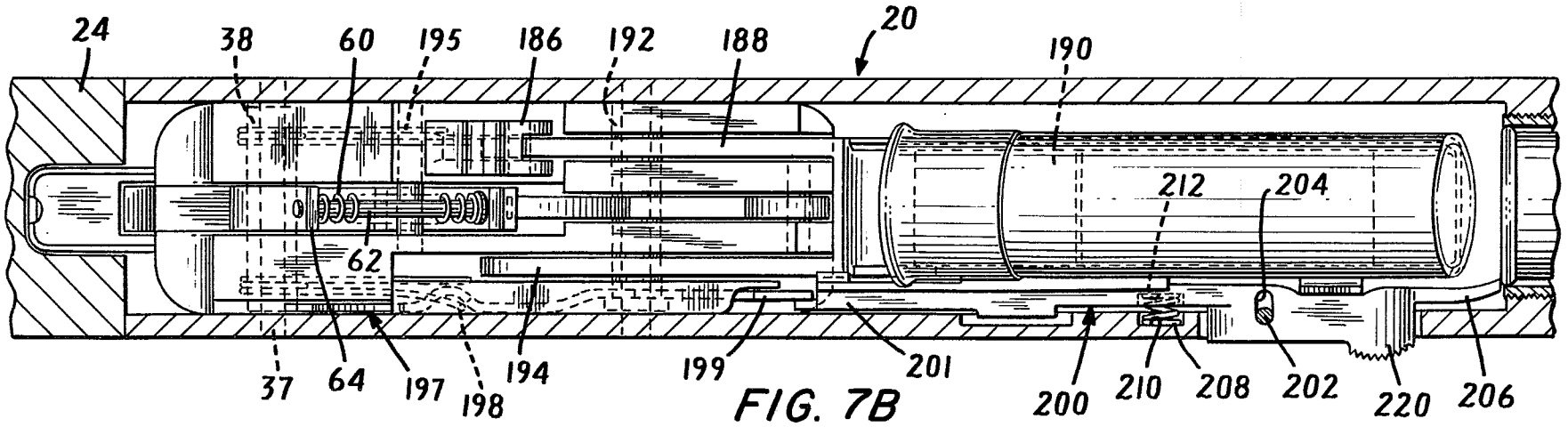
FIG. 7B is a plan similar to 7A, but showing the shell carrier in its position shown in FIG. 5.
Figure 9:
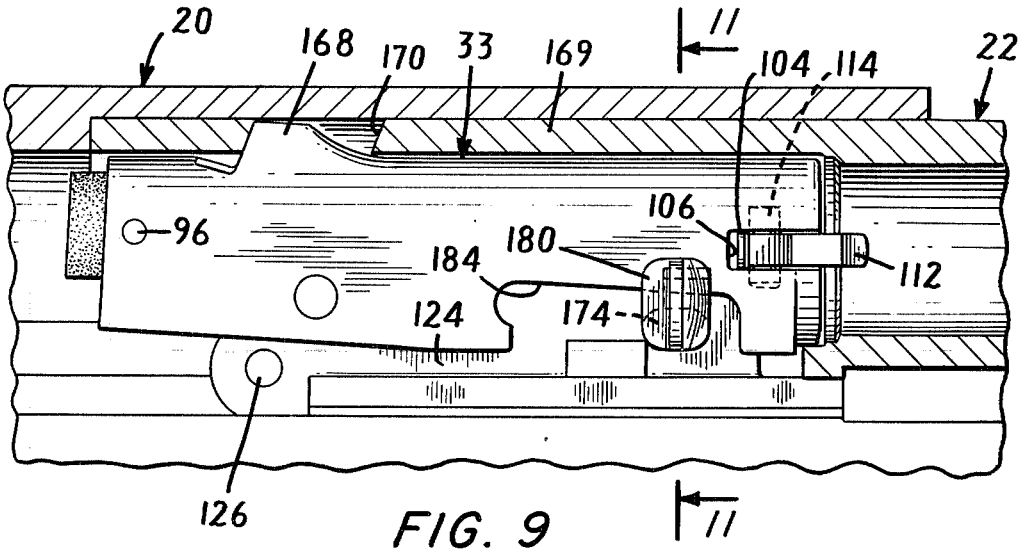
FIG. 9 is an elevation showing the bolt and charging handle in breech position.

As shown in FIG. 7B, the front end 199 of the release lever 197 engages the inside face of the rearward end 201 of a lever 200. The lever 200 is mounted for rotation in a horizontal plane on a vertically extending pivot pin 202 mounted in the right vertical wall of the receiver 20. The pivot pin 202 extends through an elongated opening 204 in the lever 200 to enable the lever to pivot laterally in the receiver 20, and also to pivot bodily about its end 201 in a lateral direction outward from the receiver to allow shells to be fed into the magazine.

The forward end 206 of the lever is curved inwardly and ends adjacent the rear mouth of the magazine 32. As shown in FIG. 7B, when the lever 200 is disposed parallel to the wall of the receiver 20 with the outer end of the elongated slot 204 engaging the pin 202, the end 206 of the lever 200 lies across an edge of the rear mouth of the magazine and engages the rim of the rearmost shell in the magazine 32 to block the shell from moving rearwardly into the receiver.

Figure 5:
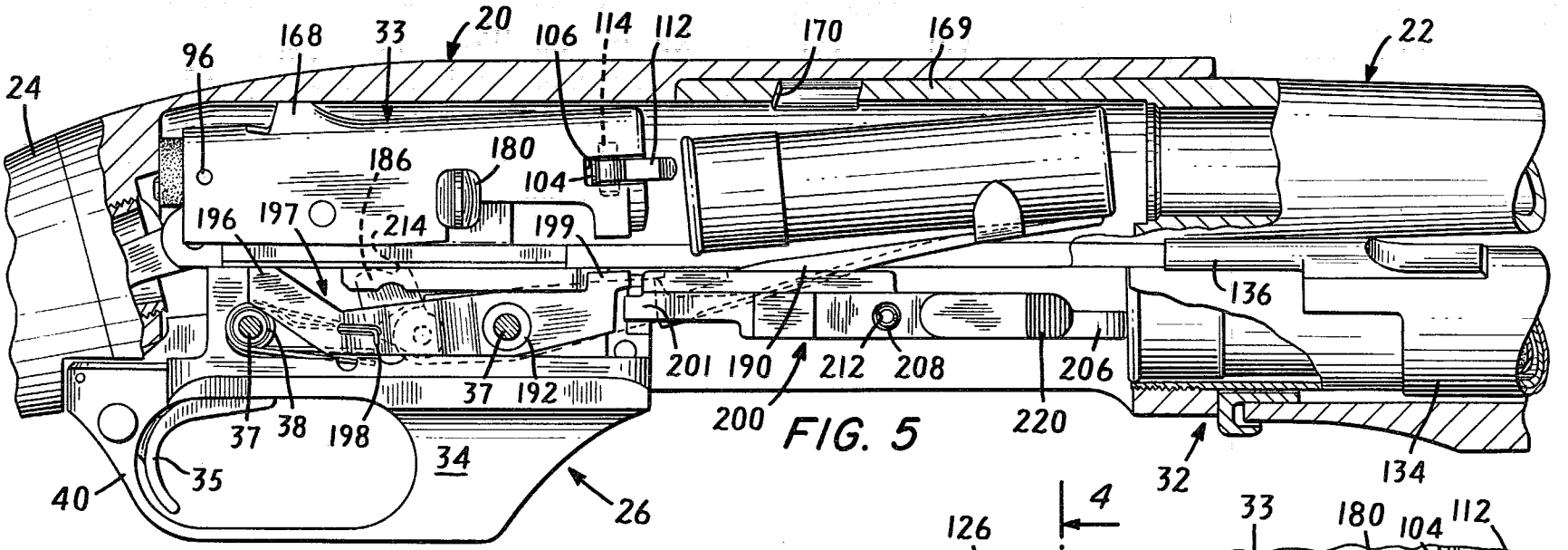
FIG. 5 is an elevation with the right hand receiver wall cut away, showing the gun as the bolt is moving forward to chamber a shell.

A coil spring 208 is compressed between the lever 200 and the wall of the receiver, and lies within a recess 210 in the receiver and an oppositely disposed recess 212 in the lever 200. When the release lever 197 is rotated counterclockwise as shown in FIG. 5 by the slide block 124, the front end 199 of the release lever 197 lifts clear of the rear end 210 of the lever 200 and releases the lever 200 for rotation by the spring 208 about the pin 202 in a clockwise direction into ghe angularly displaced position shown in FIG. 7A in which the rear end 201 of the lever 200 projects into the interior of the receiver 20 above the shell carrier 190, and the forward end 206 of the lever 200 is retracted away from the mouth of the magazine and toward the outside of the receiver, where it no longer blocks the mouth of the magazine. The rearmost shell is thereby released to move rearwardly, under the influence of the magazine spring, onto the shell carrier 190 in the receiver.

As the shell, released by the outwardly pivoted front end 206 of the lever 200, moves rearwardly into the receiver, from the magazine, the rim of the shell engages the intermediate portion of the lever 200 to the rear of the pivot pin 202 and begins to rotate the lever in a counterclockwise direction about the pivot pin 202 thereby swinging the forward end of the lever 200 back toward the mouth of the magazine to block the following shells in the magazine. Since the rim of the shell is of larger diameter than the body of the shell, the forward end 206 of the lever 200 does not interfere with the rearward movement of the shell onto the shell carrier 190 as the lever completes its counterclockwise direction into the position shown in FIG. 7A, and therefore the movement of the shell onto the shell carrier is free and unhindered by the lever 200.

As the front extremity of the shell clears the magazine, the front edge of the front portion 206 of the lever 200 lies across an edge of the mouth of the magazine as shown in FIG. 7B to engage the rim of the following shell and prevent it from moving rearwardly into the receiver to a position in which it could jam the mechanism.

When it is desired to load shells into the magazine, the stop lever is rotated counterclockwise by pushing on a release button 220 formed on the lever 200 and extending through an opening in the receiver. Counterclockwise rotation of the stop lever swings the lever 200 further into its recess in the receiver wall, and no longer overlies the shell carrier 190. The shell carrier is thus free to rotate upwardly into the receiver so that shells can be simply pushed past the shell carrier 190, which pivots upwardly into the receiver, and fed into the magazine 32. Because of the elongated opening 204, the lever 200 is able to rotate outward about its rear end 201 against the force of the spring 208 so that the front end 206 can swing outwardly to enable the rim of the shell to pass into the magazine without the necessity of the rear end of the lever 200 swinging inwardly into the receiver beyond the position shown in FIG. 7B, which it would be unable to do because the shell carrier is pivoted upwardly into the path of the rear end 201 of the lever 200 when shells are being loaded into the magazine.

Looking now at FIGS. 1 and 5, when the slide block 124 reaches the rear extent of its travel and beings returning forwardly under the action of the return spring (not shown) in the stock, acting on the plunger 116, a forward projection 214 on the shell carrier cam 186 engages the rear end 216 of a notch 218 formed in the under surface of the left wing 128 of the slide block 124. If the cam 186 is unable to move vertically downward from the slide block 124, the projection 214 will jam in the end of the groove 218 and prevent the slide from further movement rearward. Since the cam 186 is mounted on the rear end of the leg 188 of the shell carrier 190, if the shell carrier 190 is free to pivot counterclockwise about its pivot pin 192, it will do so under the influence of the return spring acting on the slide block 124. The shell on the shell carrier 190 is thus elevated toward the breech of the barrel as shown in FIG. 5, and the forwardly moving bolt drives the shell into the chamber of the barrel 22.

When the shell carrier rises to the position shown in FIG. 5, it lifts the shell clear of the lever 200. The lever 200 however, remains in the position shown in FIG. 7B because the carrier 190 extends upwardly into the path which the end 201 of the lever 200 would take in moving to the position shown in FIG. 7A. Thus, the shell carrier 190 in its raised position shown in FIG. 5 holds the lever 200 in its position shown in FIG. 7B.

Figure 6:
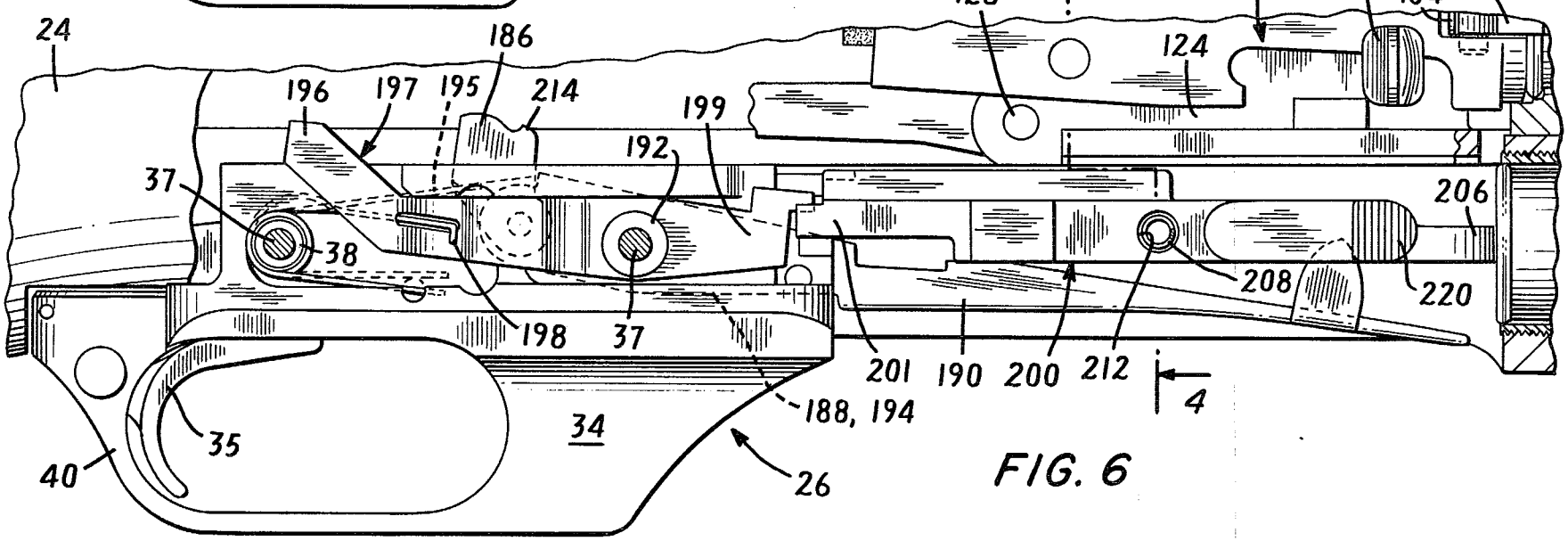
FIG. 6 is an elevation with the right hand receiver wall cut away, of the gun in breech position.

As the slide block 124 moves forward, it first clears the rear leg 196 of the release lever 197 which rotates clockwise under the action of its biasing spring 198 to the position shown in FIG. 6 in which the front end 199 of the release lever 197 lies inside of the rear end 201 of the lever 200. The end 199 of the release lever again blocks the end 201 of the lever 200 which has been held in its position adjacent the wall of the receiver as shown in FIG. 7B, while the shell carrier 190 was in its elevated position.

As the slide block 124 continues forward, it clears the cam 186 and removes the downward restraint holding the carrier 190 in its counterclockwise position, shown in FIG. 5, so that the spring 195 lifting the rear end of the shell carrier 190, lowers its front end to the position shown in FIGS. 1 and 6. The shell carrier is again in a position to receive the next shell to be released by the lever 200 from the magazine.

If there are no more shells in the magazine after the last shell has been fired, the release lever 197 will be rotated counterclockwise normally by the rearwardly moving slide block 124, and the lever 200 will be released normally and pivot to its position shown in FIG. 7A. However, since there are no more shells in the magazine to cam the lever 200 back to its position in the receiver wall recess, as shown in FIG. 7A, the lever 200 will remain projecting over the shell carrier 190. The shell carrier 190 will thus be blocked by the lever 200 from rising to the position shown in FIG. 5 so that when the slide 124 begins forward movement under the action of the return spring, (not shown) the front projection 214 of the shell carrier cam 186 will jam in the rear end 216 of the notch 218 in the bottom surface of the slide block 124 and the slide and bolt will be locked in open position. The shooter may then load a shell, through the ejection port in the receiver, into the chamber of the barrel. He can then push the release button 220 on the lever 200 to cause the lever 200 to pivot counterclockwise about its pivot pin 202. The counterclockwise pivoting of the lever 200 causes the rear end 201 to swing into its recess in the right wall of the receiver, clearing the shell carrier 190. The shell carrier 190, now unblocked by the lever 200, is free to pivot upwardly toward the position shown in FIG. 5 under the action of the return spring (not shown) acting on the slide block 124 through the cam 186 on the shell carrier leg 188. The slide block and bolt now move forward normally to the breech position shown in FIGS. 1 and 6. The shooter then loads the magazine as described above and the gun is fully loaded and ready to fire.

To field strip the gun for cleaning and oiling, the trigger housing assembly 126 is removed by simply pushing the pins 37 completely through the bushing 38 and 192 and out of the receiver. The trigger housing assembly can then be removed from the bottom of the receiver.

To remove the barrel 22 and slide tube 134, the forend nut is unscrewed by hand from a cylindrical forward extension 222 of the magazine, which extends concentrically through a central bore in the stationary gas piston 144. The forearm stock is withdrawn forwardly, and the barrel can then be removed forwardly out of the receiver, with the gas piston 144 sliding forwardly off the magazine extension 222. The slide tube 134 is now free to slide forwardly off the magazine.

To remove the bolt 33 and the slide assembly 28, the charging handle 172 is removed by tipping the forward end of the bolt 33 upwardly and simply withdrawing the charging handle. The bolt and slide are then pushed rearwardly to the rear of the receiver where the receiver widens below the guide grooves 130 so that the slide block 124 may drop vertically in the receiver. The bolt is pushed rearwardly to clear the pin 166 from the slot 164 in the slide block 124, and the slide block 124 can pivot downwardly about pivot pin 126 which frees the bolt assembly to slide forwardly out of the front of the receiver. The slide block 124 can then be removed out of the bottom of the receiver pulling after if the link 120, the plunger 116 and the return spring (not shown).

To disassemble the bolt assembly 33, it is necessary merely to push the pin 96 laterally out of the bolt which enables the firing pin 86 and the firing pin spring 88 to be withdrawn rearwardly out of the end of the bolt. The extractor retainer 100 and the extractor 110 is then loose and falls out of the bottom of the bolt.

To remove the stop lever 200, it is necessary merely to withdraw the pin 202 downwardly out of the receiver which frees the stop lever to be removed from the bottom of the bolt.

Thus, it is apparent that the gun disclosed herein can be field stripped completely without the use of tools to make accessible the interior of the receiver and all working parts for easy cleaning and lubrication. For example, even the gas system, normally the dirtiest part in a gas operated gun, and the hardest to clean, is easily cleaned on this gun. The gas cylinder 154 which, like the gas piston 144, is made of stainless steel, can be easily removed from the gas piston 144 once the barrel 22 has been removed from the receiver, by simply removing the snap ring 156 and sliding the cylinder 154 off the piston 144.

The described easy field strip operation is just as easily done in reverse to reassemble the gun which is a convenience to the shooter and represents a substantial economy in the assembly and operation at the plant where the gun is first assembled.

Obviously, numerous modifications may be made to particular embodiment described herein without departing from the spirit and scope of the appended claims, which alone define the invention.

I claim:

1. In a gas operated firearm having a barrel, a receiver, a magazine for supplying shells in succession to the receiver, a carrier within the receiver for moving shells received from the magazine to chambering position, bolt means for chambering shells and closing the breech end of the barrel, shell feed control means for coordinating the feeding of shells from the magazine, the movement of the carrier, and the chambering movement of the bolt, slide means for driving the bolt means, and gas operated means for operating the slide means, the improvement in the shell feed control means comprising:

a carrier latch lever, said firearm having a single shell stop which is formed integrally on said lever, said lever being pivotally mounted in said receiver for a. latching the shell carrier in a lowered, shell-receiving position, b. releasing a single shell from the magazine to be moved rearward under the action of the magazine spring onto the shell carrier, c. stopping the following shell in the magazine immediately after the previous shell has left the magazine, and d. releasing the shell carrier for subsequent pivoting movement thereof into chambering position.

2. The gas operated firearm defined in claim 1, wherein the improvement further comprises:

a release lever operated by said slide means for latching said lever in said cartridge stopping position when said bolt is in the breech position.

3. The gas operated firearm defined in claim 2, wherein said stop lever is pivotally mounted on a pivot pin extending perpendicular to the axis of said gun, said lever having an elongated opening through which the pivot pin extends and is biased inwardly by a spring acting on said stop lever but is movable outwardly to permit the shells to be loaded past said lever into said magazine, and then springs back into shell stopping position immediately thereafter.

4. In a gas operated firearm having a receiver, an attached barrel, a trigger housing attached to the receiver, a tubular magazine mounted beneath the barrel and connected to the receiver, a bolt including means to lock the bolt in breech position in the receiver, slide means for locking and unlocking the bolt during forward and rearward travel of the slide and a shell carrier mounted in the trigger housing adjacent the end of the tubular magazine for receiving shells from the magazine and lifting them toward the breech of the barrel to be chambered by the bolt sliding forward, wherein the improvement comprises:

a one piece lever pivotally mounted in the receiver adjacent the shell carrier and having at least four different positions in which the stop lever 1. releases a shell from the magazine and blocks the carrier from pivoting upward into the receiver, 2. stops a shell from leaving the magazine and releases the carrier for lifting a shell upward to the breech of the barrel, 3. releases the carrier to pivot upward into the receiver, and pivots outward to enable shells to be fed into the magazine, and 4. stops a shell from leaving the magazine and blocks the carrier from pivoting upward into the receiver.

5. The gas operated firearm as defined in claim 4, further comprising an elongated opening in said lever, having a vertical axis, for receiving a pivot pin and a spring for biasing said lever into said carrier blocking position, and a release lever pivotally mounted in end-overlapping relation to said stop lever and operated by said slide to release said stop lever.

6. In a firearm having a receiver, a barrel connected at its rear end to the receiver, a magazine connected to the receiver for feeding shells in succession into the receiver, a carrier within the receiver for receiving shells fed from the magazine and transferring them to chambering position, a bolt for chambering shells and closing the breech end of the barrel, a slide movable forward and rearward in the receiver for driving the bolt and, means for operating the slide, the improvement comprising shell feed control means for coordinating the feeding of shells from the magazine, the movement of the carrier, and the chambering movement of the bolt, said shell feed control means including:

a single stage shell stop and carrier latch bar mounted in said receiver for pivotal movement about at least one vertical axis and translational movement at said axis, for selectively assuming positions in which it a. latches the shell carrier in a shell-receiving position while it stops the shells in the magazine from feeding onto the carrier, b. releases a single shell from the magazine to move rearwardly from the magazine onto the shell carrier while it latches the carrier in shell receiving position, c. stops the following shell in the magazine from protruding beyond the magazine onto the carrier, and d. releases the shell carrier for pivoting movement thereof into chambering position while it stops the shells in the magazine from feeding toward the receiver.

7. The firearm defined in claim 6, wherein said shell feed control means further comprises:

a release lever operated by said slide for enabling said bar to release a cartridge when said bolt is in the rear of said receiver.

8. The firearm defined in claim 6, wherein said bar is pivotally mounted on a vertical pivot pin and has an elongated opening through which the pivot pin extends, a spring acting on said bar to bias said bar inwardly but resiliently yielding to permit said bar to move outwardly when shells are being loaded into said magazine.

9. In a firearm having a receiver, a barrel connected at its rear end to the receiver, a magazine connected to the receiver for feeding shells in succession into the receiver, a carrier within the receiver for receiving shells fed from the magazine and transferring them to chambering position, a bolt for chambering shells and closing the breech end of the barrel, a slide movable forward and rearward in the receiver for driving the bolt and, means for operating the slide, the improvement comprising shell feed control means for coordinating the feeding of shells from the magazine, the movement of the carrier, and the chambering movement of the bolt, said shell feed control means including:

a single, integral shell stop and carrier latch bar mounted in said receiver for pivotal movement about a vertical axis and for translational movement at said axis;

means for moving said bar and controlling the movement thereof selectively between positions thereof at which said bar a. latches the shell carrier in a shell-receiving position while it stops the shells in the magazine from feeding onto the carrier, b. releases a single shell from the magazine to move rearwardly from the magazine onto the shell carrier while it latches the carrier in shell receiving position, c. stops the following shell in the magazine from protruding beyond the magazine onto the carrier while it releases the shell carrier for pivoting movement thereof into chambering position, and d. releases the shell carrier for movement thereof into the receiver while it passes shells being loaded into the magazine.

10. The firearm defined in claim 9, wherein said moving and controlling means includes a release lever biased in one direction and operable, when said slide operates, to move in the opposite direction and release said bar to release a single shell from said magazine into said receiver.

11. The firearm defined in claim 9, wherein said bar is mounted intermediate its ends on a pivot pin having a vertical axis and said release lever is biased to a position at which it prevents one end of said bar from swinging inward about said pivot pin, and said release lever is operated when said slide operates to release said bar to pivot said one end inward about said pivot pin, and to pivot the other end of said bar outward to release one shell from said magazine onto said carrier.

* * * * *